United States Patent [19]

Sanders

[11] Patent Number: 5,050,745

[45] Date of Patent: Sep. 24, 1991

[54] EARRING STORAGE HOLDER

[76] Inventor: Patricia A. Sanders, 2108 Neilson Way, Santa Monica, Calif. 90405

[21] Appl. No.: 608,173

[22] Filed: Oct. 31, 1990

[51] Int. Cl.[5] ..... A47F 7/00

[52] U.S. Cl. ..... 211/13; 211/113; 206/495

[58] Field of Search ..... 211/113, 118, 13

[56] References Cited

U.S. PATENT DOCUMENTS

| | | | |
|---|---|---|---|
| 4,606,458 | 8/1986 | LaBate | 206/495 X |
| 4,687,103 | 8/1987 | Corbett | 206/495 X |
| 4,811,996 | 3/1989 | Hansson | 206/566 X |
| 4,821,883 | 4/1989 | Miller | 206/495 |
| 4,905,821 | 3/1990 | Corbett | 206/566 X |
| 4,958,727 | 9/1990 | Bergeron | 206/495 X |

*Primary Examiner*—Robert W. Gibson, Jr.
*Attorney, Agent, or Firm*—Roger A. Marrs

[57] ABSTRACT

A holder for both clip-on and pierced earrings is disclosed herein having a frame mounting a net or screen about it's edge marginal region and a loop-like leash attached to the top of the frame. Clip-on earrings are attached to the leash while pierced earrings couple to the net in a random display. The edge marginal regions of the net are adhesively secured to a recessed shoulder on the back of the frame. A mat is employed to cover the edge marginal region and to provide reinforcement.

2 Claims, 1 Drawing Sheet

EARRING STORAGE HOLDER

BACKGROUND OF THE INVENTION

1. Field of the Invention

The present invention relates to the field of earring holders or supports and more particularly to a novel holding devise for removably supporting earrings of the clip-on type or of the pierced ear type in such a manner that the arrangement provides a display as well as storage.

2. Brief Description of the Prior Art

In the past, it has been the conventional practice to store earrings in a jewelry box or to suspend the earrings on a metal rack when the earrings are not in use. In employing a rack, most conventional racks are used for earrings of the pierced ear type and seldom can clip-on earrings be stored on such racks in a convenient manner. Furthermore, storage racks are unsightly and it is sometimes difficult to view all of the earrings at one time in order to make a selection when it is intended to choose earrings for display. Furthermore, most conventional racks are limited to the number of earrings pairs that can be stored and when a jewelry box is used, the earrings are oftentimes separated so that pairs cannot be rematched and the earrings tend to cling to one another in an unsightly and tangled mass.

Therefore, a long standing need has existed to provide a novel storage and display means for holding a quantity of earrings both of the clip-on and the pierced ear type. Such a holder should be not only capable of storing a quantity of such earrings but should present the stored earrings in a display which is not only ornamental but which will permit the user to readily choose selected pairs for a given occasion.

SUMMARY OF THE INVENTION

Accordingly, the above problems and difficulties are obviated by the present invention which provides a novel display means for storing a quantity of earrings of both the clip-on and the pierced ear type. One form of the invention, the means provides a frame for holding a netting or screen across the central opening of the frame so that the pierced earring type may be coupled in a random fashion about the front surface of the netting. The attachment for the pierced earring type is coupled to the ornamental portion from the rear of the screen or net and clip-on earrings may be placed on a looped leash suitably fastened to the top of the frame. A matting in the configuration of the frame is placed about the edge marginal region of the net or screen for reinforcement and suitable adhesive or other attachment means is used for securing the mat and the screen or net to the back side of the frame.

Therefore, it is among the primary objects of the present invention to provide a novel storage and display means for holding a quantity of earrings of both the clip-on and pierced ear type in such a manner that an ornamental display is provided as well as temporary storage for the quantity of earrings.

Another object of the present invention is to provide a novel means for storing a variety of types of earrings which is ornamental and which will permit the user to visually review the stored earrings for selection.

Yet another object of the present invention is to provide a novel means for storing a variety of earrings in a convenient manner and in such a manner that future selection may be readily made by the user for a desired occasion.

BRIEF DESCRIPTION OF THE DRAWINGS

The features of the present invention which are believed to be novel are set forth with particularity in the appended claims. The present invention, both as to it's organization and manner of operation, together with further objects and advantages thereof, may best be understood with reference to the following description, taken in connection with the accompanying drawings in which:

DESCRIPTION OF THE PREFERRED EMBODIMENT

Figure 1:
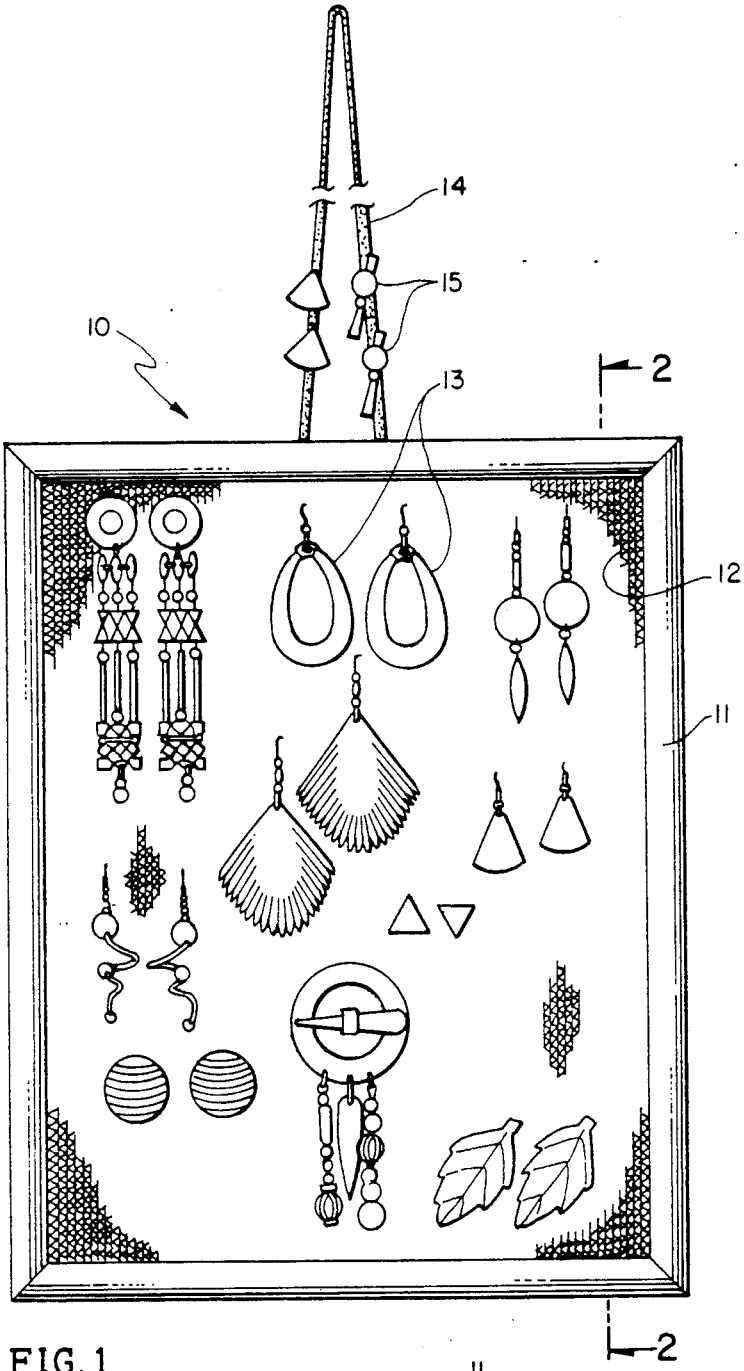
FIG. 1 is a front plan view of the novel earring storage holder of the present invention.

Referring to FIG. 1, the novel earring storage holder of the present invention is illustrated in the general direction of arrow 10 which includes a frame 11 having top and bottom linear members attached at their opposite ends to opposite ends of side linear members so that a central area is defined between the opposing surfaces or edges of the members. The opening is covered by a screen or net mesh member indicated by numeral 12. The mesh or openings of the net or screen may be of a suitable size from small to large so that a variety of hooks, earring post or the like may be pressed through the openings in the mesh. This will permit the decorative portion of the earring to hang on one side of the net or screen while the attachment portion is coupled to the earring from the rear of the screen or net. A suitable pair of earrings is indicated by the numeral 13 which illustrates, as example, a pair of earrings each having a hook. However, it is to be understood that earrings for pierced ears of the post and fastener type may also be employed.

FIG. 1 further illustrates that the top linear member of the frame 11 includes a loop-type leash 14 having its opposite end secured by a suitable adhesive or other fastening means to the back side of the frame 11. The leash is employed for supporting a plurality of earrings of the clip-on type as represented by numeral 15.

Figure 2:
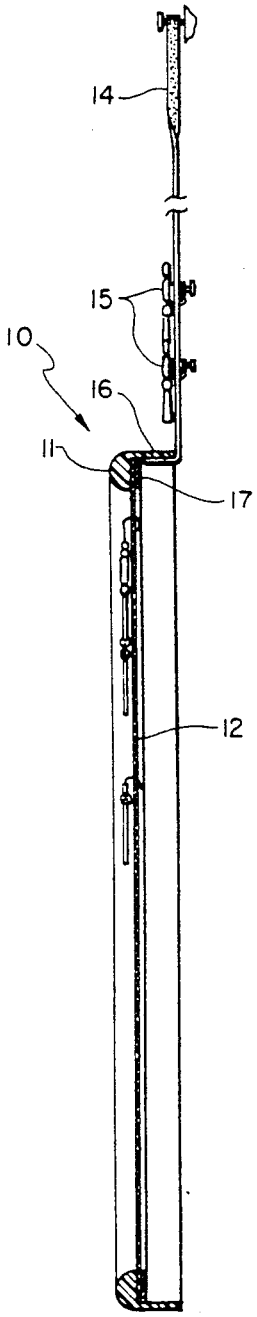
FIG. 2 is a longitudinal cross sectional view of the earring storage holder shown in FIG. 1 as taken in the direction of arrows 2—2 thereof.

Referring now in detail to FIG. 2, it can be seen that the edge marginal region of screen or net 12 is adhesively secured to the back side of frame 11 within a recess formed by a rearwardly extending shoulder 16. A suitable mat is indicated by numeral 17 that backs the edge marginal region of the net or screen 12 and is secured as a reinforcing member by adhesive or the like.

Figure 3:
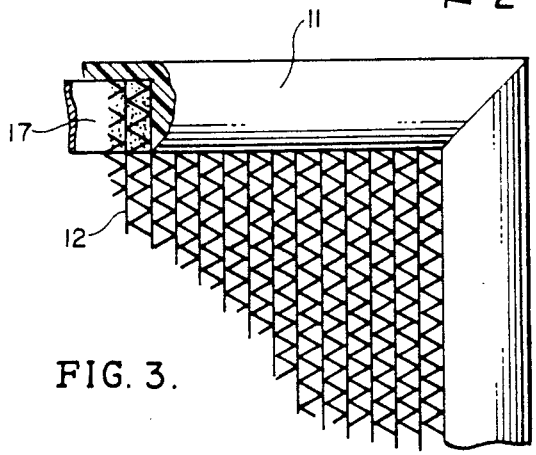
FIG. 3 is a fragmentary sectional view of a portion of the earring storage holder illustrating the attachment of the net or screen to the frame.

In FIG. 3, the mesh of the screen is shown in an enlarged manner while the mat 17 is illustrated sandwiching the edge marginal region of the net or screen to the backside of frame 11 within the defined recess.

Therefore, it can be seen that the inventive earring storage holder of the present invention provides a front surface on the net or screen so that the ornamental portion of the earring may be displayed or reviewed by the user. The back side of the net or screen accomodates the fastener for a post type earring of the pierced ear type or the hook of the same type of earring. The leash 12 is used for clip-on earrings and the entire assembly may be displayed on a wall by use of a hook or nail over which the leash is suspended or the unit may be placed on a flat surface, such as a dresser, table or desk. It is also envisioned that the frames may be used in multiple fashion such as being joined by hinges or fixed connectors.

While particular embodiments of the present invention have been shown and described, it will be obvious to those skilled in the art that changes and modifications may be made without departing from this invention in its broader aspects and, therefore, the aim in the appended claims is to cover all changes and modifications as fall within the true spirit and scope of this invention.

What is claimed is:

1. A holder for storing and displaying earrings comprising:

a frame having top and bottom members joined at their opposite ends with side members to define a central opening area;

a netting secured to said respective members occupying said central opening area and having its edge marginal region fixedly secured to said members so as to make said netting taut;

said netting having a plurality of openings defined as close mesh for insertably receiving mounting fasteners of earrings;

said netting supporting the earrings in a random display visually available to the user;

said earrings comprise both clip-on and pierced ear types;

a closed loop carried on said top member for supporting earrings of said clip-on type; and a reinforcing mat secured to said netting edge marginal region sandwiching said edge marginal region against the backside of said frame members.

2. The invention as defined in claim 1 wherein:

said frame members include a rear recess at the backside of said frame for receiving and securing with said netting edge marginal region.

* * * * *